US009613553B2

(12) United States Patent
You et al.

(10) Patent No.: US 9,613,553 B2
(45) Date of Patent: Apr. 4, 2017

(54) METHOD AND DEVICE FOR DETECTING UNIFORMITY OF A DARK STATE IMAGE OF DISPLAY

(71) Applicant: Boe Technology Group Co., Ltd., Beijing (CN)

(72) Inventors: Jaegeon You, Beijing (CN); Yafeng Yang, Beijing (CN); Kiman Kim, Beijing (CN); Qian Jia, Beijing (CN)

(73) Assignee: Boe Technology Group Co., Ltd., Beijing (CN)

( * ) Notice: Subject to any disclaimer, the term of this patent is extended or adjusted under 35 U.S.C. 154(b) by 212 days.

(21) Appl. No.: 14/500,648

(22) Filed: Sep. 29, 2014

(65) Prior Publication Data

US 2015/0317929 A1 Nov. 5, 2015

(30) Foreign Application Priority Data

May 5, 2014 (CN) ..... 2014 1 0186326

(51) Int. Cl.
*G09G 3/00* (2006.01)
*G09G 3/20* (2006.01)

(52) U.S. Cl.
CPC ..... *G09G 3/006* (2013.01); *G09G 3/2092* (2013.01); *G09G 3/2003* (2013.01); (Continued)

(58) Field of Classification Search
None
See application file for complete search history.

(56) References Cited

U.S. PATENT DOCUMENTS 6,198,843 B1 * 3/2001 Nakauchi ..... G06T 11/001 358/518
6,373,596 B1 * 4/2002 Hidaka ..... H04N 1/6088 358/1.9

(Continued)

FOREIGN PATENT DOCUMENTS

CN 102063888 5/2011
CN 102625111 8/2012

(Continued)

OTHER PUBLICATIONS

Office action from Chinese Application No. 201410186326.8 dated Jan. 5, 2016.

*Primary Examiner* — Barry Drennan
*Assistant Examiner* — Jason Pringle-Parker
(74) *Attorney, Agent, or Firm* — Calfee, Halter & Griswold LLP

(57) ABSTRACT

A method and device for detecting uniformity of a dark state image of a display is disclosed. After an acquired dark state image of a display panel is divided into a plurality of areas according to a preset rule, RGB values of each area are determined and converted into XYZ values. The L* and C* values in the CIE-LCH standard are calculated and statistical analysis is performed to the L* and C* values of the areas in the dark state image to determine statistical parameters of the display image. A dark state uniformity coefficient of the dark state image is determined based on the determined statistical parameters, and the uniformity of the dark state image of the display panel is determined through the dark state uniformity coefficient.

12 Claims, 1 Drawing Sheet

(52) U.S. Cl.
CPC ..... *G09G 2320/0233* (2013.01); *G09G 2320/0238* (2013.01); *G09G 2320/0242* (2013.01); *G09G 2320/0666* (2013.01); *G09G 2340/06* (2013.01)

(56) References Cited

U.S. PATENT DOCUMENTS

| | | | | |
|---|---|---|---|---|
| 2006/0170940 | A1* | 8/2006 | Kang | H04N 1/6058 358/1.9 |
| 2007/0091337 | A1* | 4/2007 | Morovic | H04N 1/6058 358/1.9 |
| 2008/0088894 | A1 | 4/2008 | Wang et al. | |
| 2009/0097760 | A1* | 4/2009 | Bezryadin | G06T 11/001 382/232 |
| 2010/0195173 | A1* | 8/2010 | Dalrymple | H04N 1/6075 358/520 |
| 2011/0115836 | A1* | 5/2011 | Wan | G09G 5/02 345/691 |

FOREIGN PATENT DOCUMENTS

| | | |
|---|---|---|
| CN | 102629379 | 8/2012 |
| CN | 102723065 | 10/2012 |
| CN | 103686151 | 3/2014 |

* cited by examiner

METHOD AND DEVICE FOR DETECTING UNIFORMITY OF A DARK STATE IMAGE OF DISPLAY

RELATED APPLICATIONS

The present application claims the benefit of Chinese Patent Application No. 201410186326.8, filed May 5, 2014, the entire disclosure of which is incorporated herein by reference.

FIELD OF THE INVENTION

The present invention relates to the field of display technology, specifically to a method and device for image detection.

BACKGROUND OF THE INVENTION

With the development of photoelectric technology and semiconductor manufacturing technology, the flat-panel display has replaced the traditional CRT display to become the mainstream display device. Flat-panel displays are flexible and easy to carry. The liquid crystal display (LCD), with features including high image quality, high space utilization, low energy power, and no radiation has become the mainstream product in the flat panel display market. In the television field especially, LCD devices have the greatest market share. Compared to the LCD, the organic light emitting diode (OLED) display has also become a mainstream display device due to its fast response time, wide color gamut, ultrathin profile and flexibility.

A series of detections need to be performed on either an LCD or OLED display device before leaving the factory, which includes uniformity detection of brightness of the dark state image of the display. The existing detection is generally performed manually, i.e., adjusting the display to display a black image and determining whether light leakage exists in the screen by comparing, by human eye, whether the brightness of each area of the screen of the display is uniform. It is difficult to have a unified standard when using a human eye for detection and a missed detection may easily occur.

Therefore, unified detection of uniformity of a dark state image of a display is an urgent technical problem in the flat-panel display field.

SUMMARY OF THE INVENTION

In view of this, an embodiment of the present invention provides a method for image detection, which can be used for unified detection of uniformity of the dark state image of the display.

Therefore, the embodiment of the present invention provides a method for image detection including determining RGB values of each area after an acquired dark state image of a display panel is divided into a plurality of areas according to a preset rule, calculating corresponding XYZ values of each area in the CIE-XYZ standard respectively based on the RGB values of each area, calculating L* and C* values of each area in the CIE-LCH standard respectively based on the XYZ values of each area, performing statistical analysis to the L* and C* values of the areas in the dark state image so as to determine statistical parameters of the display image, the statistical parameters including the maximum value, the mean value, the normally distributed 3σ value, and the Sobel value of the L* and C* values, determining a dark state uniformity coefficient of the dark state image based on the determined statistical parameters, and determining uniformity of the dark state image of the display panel through the dark state uniformity coefficient.

According to the above method for image detection provided by the embodiment of the present invention, after an acquired dark state image of a display panel is divided into a plurality of areas according to a preset rule, the RGB values of each area are determined and converted into an XYZ values and the L* and C* values in the CIE-LCH standard are calculated, statistical analysis is performed to the L* and C* values of the areas in the dark state image, so as to determine statistical parameters of the display image, a dark state uniformity coefficient of the dark state image is determined based on the determined statistical parameters, and the uniformity of the dark state image of the display panel is determined through the dark state uniformity coefficient. A standard for evaluating uniformity of a dark state image is established through the above process, which facilitates unified detection of uniformity of the dark state image of the display panel.

In a possible implementation, the above method for image detection provided by the embodiment of the present invention, after calculating corresponding XYZ values of each area in the CIE-XYZ standard respectively based on the RGB values of each area, further includes performing linear transformation of reverse colors to the corresponding XYZ values of each area in the CIE-XYZ standard, amending the linear transformed values based on empirical values detected by human eye, and performing an inverse linear transformation to the amended values.

In a possible implementation, in the above method for image detection provided by the embodiment of the present invention, performing linear transformation of reverse colors to the corresponding XYZ values of each area in the CIE-XYZ standard includes performing linear transformation of reverse colors to the corresponding XYZ values in the CIE-XYZ standard respectively through the following formulae:

$$W/B=0.279\times X+0.72\times Y-0.107\times Z$$

$$R/G=-0.449\times X+0.29\times Y-0.077\times Z,$$

$$B/Y=0.086\times X+0.59\times Y-0.501\times Z$$

wherein W/B represents reciprocal transformation of brightness, R/G represents reciprocal transformation from red to green, B/Y represent reciprocal transformation from blue to yellow.

In a possible implementation, in the above method for image detection provided by the embodiment of the present invention, amending the linear transformed values based on empirical values of human eye includes amending the W/B representing reciprocal transformation of brightness, the R/G representing reciprocal transformation from red to green, and the B/Y representing reciprocal transformation from blue to yellow respectively with the following functions:

$$f = k\sum_i w_i E_i,\ E_i = k_i \exp(-(x^2+y^2)/s_i^2),$$

wherein $w_i$ represents weight coefficient, $s_i$ represents expansion coefficient, $k_i$ represents proportionality coefficient, and x, y and z represent coordinate values in chroma space, where x+y+z=1.

In a possible implementation, in the above method for image detection provided by the embodiment of the present invention, performing an inverse linear transformation to the amended values includes inverse linear transforming the amended W/B' representing reciprocal transformation of brightness, the amended R/G' representing reciprocal transformation from red to green, and the amended B/Y' representing reciprocal transformation from blue to yellow into the XYZ values through the following formulae:

$$X=0.6266\times(W/B)'-1.8672\times(R/G)'-0.1532\times(B/Y)'$$

$$Y=1.3699\times(W/B)'+0.9348\times(R/G)'+0.4362\times(B/Y)'.$$

$$Z=1.5057\times(W/B)'+1.4213\times(R/G)'+2.5360\times(B/Y)'$$

In a possible implementation, in the above method for image detection provided by the embodiment of the present invention, calculating L* and C* values of each area in the CIE-LCH standard respectively based on the XYZ values of each area includes calculating L*, a*, and b* values of each area in the CIE-Lab standard respectively based on the XYZ values of each area, calculating C* value of each area in the CIE-LCH standard based on the calculated a* and b* values of each area in the CIE-Lab standard, and taking the L* value in the CIE-Lab standard as the L* value in the CIE-LCH standard.

In a possible implementation, in the above method for image detection provided by the embodiment of the present invention, determining a dark state uniformity coefficient of the dark state image based on the determined statistical parameters includes calculating a dark state brightness uniformity coefficient L mura and a dark state chroma uniformity coefficient C mura of the dark state image respectively through the following formulae $$L\text{ mura}=(\max_L-\text{mean}_L+3\sigma_L)/2+10*\text{area ratio}_L(\text{sobel value}_L>0.5/\text{degree}+100*\text{area ratio}_L(\text{sobel value}_L>10/\text{degree}),$$

$$C\text{ mura}=0.1*(\max_C+3\sigma_C)/2+10*\text{area ratio}_C(\text{sobel value}_C>5/\text{degree})+100*\text{area ratio}_C(\text{sobel value}_C>50/\text{degree}),$$

wherein $\max_L$ represents the maximum value in the L* values of the areas, $\text{mean}_L$ represents the mean value in the L* values of the areas, $3\sigma_L$ represents the normally distributed 3σ value in the L* values of the areas, area $\text{ratio}_L$ (sobel $\text{value}_L$>0.5) represents the area ratio of the Sobel value in the L* value of each area greater than 0.5 degrees; area $\text{ratio}_L$ (sobel $\text{value}_L$>10/degree) represents the area ratio of the Sobel value in the L* value of each area greater than 10 degrees, $\max_C$ represents the maximum value in the C* values of the areas, $\text{mean}_C$ represents the mean value in the C* values of the areas, $3\sigma_C$ represents the normally distributed 3σ value in the C* values of the areas, area $\text{ratio}_C$ (sobel $\text{value}_C$>5) represents the area ratio of the Sobel value in the C* value of each area greater than 5 degrees; area $\text{ratio}_C$ (sobel $\text{value}_C$>50/degree) represents the area ratio of the Sobel value in the C* value of each area greater than 50 degrees, and calculating a dark state uniformity coefficient index mura of the dark state image based on the dark state brightness uniformity coefficient L mura and the dark state chroma uniformity coefficient C mura through the following formulae when L* is greater than a preset brightness value, index mura=0.5L mura+0.5C mura.

when L* is smaller than a preset brightness value, index mura=0.7L mura+0.3C mura.

The embodiment of the present invention further provides a device for image detection including an image acquisition unit for acquiring a dark state image of a display panel, an RGB determination unit for determining RGB values of each area after the acquired dark state image of the display panel is divided into a plurality of areas according to a preset rule, an XYZ determination unit for calculating corresponding XYZ values of each area in the CIE-XYZ standard respectively based on the RGB values of each area, an L* and C* value determination unit for calculating L* and C* values of each area in the CIE-LCH standard respectively based on the XYZ values of each area, a statistical analysis unit for performing statistical analysis to the L* and C* values of the areas in the dark state image so as to determine statistical parameters of the display image; the statistical parameters comprising: the maximum value, the medium value, the normally distributed 3σ value, and the Sobel value of the L* and C* values, and a dark state uniformity determination unit for determining a dark state uniformity coefficient of the dark state image based on the determined statistical parameters, and determining uniformity of the dark state image of the display panel through the dark state uniformity coefficient.

In a possible implementation, the above device for image detection provided by the embodiment of the present invention further includes a linear transformation unit for performing linear transformation of reverse colors to the corresponding XYZ values of each area in the CIE-XYZ standard, an amending unit for amending the linear transformed values based on empirical values detected by human eye, and an inverse linear transformation unit for performing an inverse linear transformation to the amended values.

In a possible implementation, in the above device for image detection provided by the embodiment of the present invention, the linear transformation unit is used for performing linear transformation of reverse colors to the corresponding XYZ values in the CIE-XYZ standard respectively through the following formulae $$W/B=0.279\times X+0.72\times Y-0.107\times Z$$

$$R/G=-0.449\times X+0.29\times Y-0.077\times Z,$$

$$B/Y=0.086\times X+0.59\times Y-0.501\times Z$$

wherein W/B represents reciprocal transformation of brightness, R/G represents reciprocal transformation from red to green, B/Y represent reciprocal transformation from blue to yellow.

In a possible implementation, in the above device for image detection provided by the embodiment of the present invention, the amending unit is used for amending the W/B representing reciprocal transformation of brightness, the R/G representing reciprocal transformation from red to green, and the B/Y representing reciprocal transformation from blue to yellow respectively with the following functions $$f=k\sum_i w_iE_i,\ E_i=k_i\exp(-(x^2+y^2)/s_i^2),$$

wherein $w_i$ represents weight coefficient, $s_i$ represents expansion coefficient, $k_i$ represents proportionality coefficient, x, y and z represent coordinate values in chroma space, where x+y+z=1.

In a possible implementation, in the above device for image detection provided by the embodiment of the present invention, the inverse linear transformation unit is used for inverse linear transforming the amended W/B' representing reciprocal transformation of brightness, the amended R/G' representing reciprocal transformation from red to green, and the amended B/Y' representing reciprocal transformation from blue to yellow into the XYZ values through the following formulae $$X=0.6266\times(W/B)'-1.8672\times(R/G)'-0.1532\times(B/Y)'$$

$$Y=1.3699\times(W/B)'+0.9348\times(R/G)'+0.4362\times(B/Y)'.$$

$$Z=1.5057\times(W/B)'+1.4213\times(R/G)'+2.5360\times(B/Y)'$$

In a possible implementation, in the above device for image detection provided by the embodiment of the present invention, the L* and C* value determination unit is used for calculating L*, a*, and b* values of each area in the CIE-Lab standard respectively based on the XYZ values of each area; calculating L* and C* values of each area in the CIE-LCH standard based on the calculated L*, a*, and b* values of each area in the CIE-Lab standard.

In a possible implementation, in the above device for image detection provided by the embodiment of the present invention, the dark state uniformity determination unit is used for calculating a dark state brightness uniformity coefficient L mura and a dark state chroma uniformity coefficient C mura of the dark state image respectively through the following formulae $$L\ \text{mura}=(\max_L-\text{mean}_L+3\sigma_L)/2+10*\text{area ratio}_L(\text{sobel value}_L>0.5/\text{degree}+100*\text{area ratio}_L(\text{sobel value}_L>10/\text{degree}),$$

$$C\ \text{mura}=0.1*(\max_C+3\sigma_C)/2+10*\text{area ratio}_C(\text{sobel value}_C>5/\text{degree})+100*\text{area ratio}_C(\text{sobel value}_C>50/\text{degree}),$$

wherein $\max_L$ represents the maximum value in the L* values of the areas, $\text{mean}_L$ represents the mean value in the L* values of the areas, $3\sigma_L$ represents the normally distributed 3σ value in the L* values of the areas, area $\text{ratio}_L$ (sobel $\text{value}_L$>0.5) represents the area ratio of the Sobel value in the L* value of each area greater than 0.5 degrees; area $\text{ratio}_L$ (sobel $\text{value}_L$>10/degree) represents the area ratio of the Sobel value in the L* value of each area greater than 10 degrees, $\max_C$ represents the maximum value in the C* values of the areas, $\text{mean}_C$ represents the mean value in the C* values of the areas, $3\sigma_C$ represents the normally distributed 3σ value in the C* values of the areas, area $\text{ratio}_C$ (sobel $\text{value}_C$>5) represents the area ratio of the Sobel value in the C* value of each area greater than 5 degrees; area $\text{ratio}_C$ (sobel $\text{value}_C$>50/degree) represents the area ratio of the Sobel value in the C* value of each area greater than 50 degrees, and calculating a dark state uniformity coefficient index mura of the dark state image based on the dark state brightness uniformity coefficient L mura and the dark state chroma uniformity coefficient C mura through the following formulae when L* is greater than a preset brightness value, index mura=0.5L mura+0.5C mura, when L* is smaller than a preset brightness value, index mura=0.7L mura+0.3C mura.

DETAILED DESCRIPTION OF EMBODIMENTS

The specific implementations of the method and device for image detection provided by the embodiments of the present invention will be explained in detail below in conjunction with the drawings.

The embodiments of the present invention provide a method and a device for image detection. After an acquired dark state image of a display panel is divided into a plurality of areas according to a preset rule, the RGB values of each area are determined and converted into XYZ values. The L* and C* values in the CIE-LCH standard are calculated and statistical analysis is performed to the L* and C* values of the areas in the dark state image so as to determine statistical parameters of the display image. A dark state uniformity coefficient of the dark state image is determined based on the determined statistical parameters, and the uniformity of the dark state image of the display panel is determined through the dark state uniformity coefficient. A standard for evaluating uniformity of a dark state image is established through the above process, which facilitates unified detection of uniformity of the dark state image of the display panel.

Figure 1:
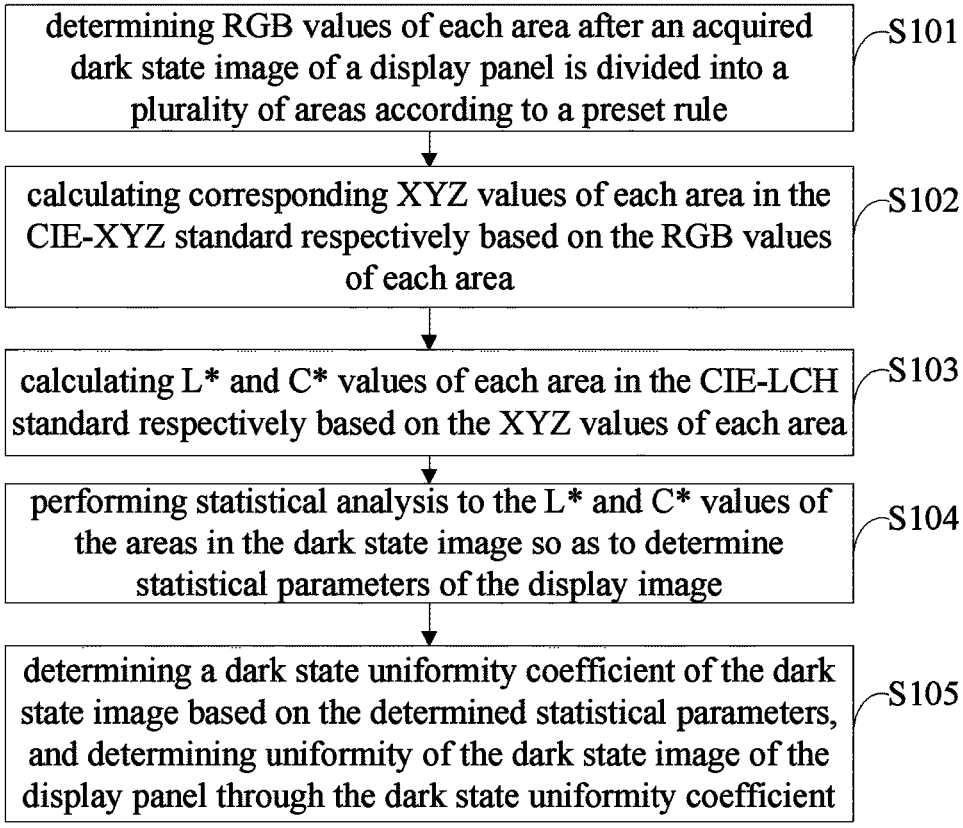
FIG. 1 is a flow chart of a method for image detection provided by an embodiment of the present invention.

A method for image detection provided by the embodiment of the present invention, as shown in FIG. 1, includes the step S101 of determining RGB values of each area after an acquired dark state image of a display panel is divided into a plurality of areas according to a preset rule. In specific implementations, image acquisition devices such as a CCD camera may be used for acquiring, from a position at an angle of 2° with the display panel, a dark state image of the display panel displaying a black image when a standard light source D65 irradiates the display panel.

Moreover, after the dark state image is acquired, in order to avoid a large amount of calculation of data when calculating the RGB values of each pixel point, the acquired dark state image can be divided into a plurality of areas according to a preset rule. For example, the dark state image acquired each time can be divided into 9*9 areas equally where there are an equal number of areas regardless of the size of the original dark state image and each area is taken as a whole to calculate the RGB values of each area. The acquired dark state image can also be divided by grouping each 9*9 pixel points into an area, then the RGB values of each area are calculated. Specific implementations, may include an actual preset division rule, which will not be limited herein.

At step S102, corresponding XYZ values of each area in the CIE-XYZ standard are respectively calculated based on the RGB values of each area. In specific implementations, the RGB values are generally in a range of 0-255. Normalization processing can be performed on the RGB values of each area first, then conversion of the coordinate system can be made. For example, the RGB values can be converted into tristimulus XYZ values with the following formulae:

$$X=(f(R)\times0.4124+f(G)\times0.3576+f(B)\times0.1805)\times100$$

$$Y=(f(R)\times0.2126+f(G)\times0.7152+f(B)\times0.0722)\times100;$$

wherein, $$Z=(f(R)\times0.0193+f(G)\times0.1192+f(B)\times0.9505)\times100$$

If R/255≻ 0.04045, then f(R)=((R 1255+0.055)/1.055)$^{2.4}$; if R/255≤0.04045, then f(R)=R/255/12.92;

If $G/255 \succ 0.04045$, then $f(G)=((G/255+0.055)/1.055)^{2.4}$; if $G/255 \leq 0.04045$, then $f(G)=G/255/12.92$;

If $B/255 \succ 0.04045$, then $f(B)=((B/255+0.055)/1.055)^{2.4}$; if $B/255 \leq 0.04045$, then $f(B)=B/255/12.92$;

At step S103, L* and C* values for each area in the CIE-LCH standard are respectively calculated based on the XYZ values of each area;

In specific implementations, firstly, the L*, and b* values of each area in the CIE-Lab standard can be calculated respectively based on the XYZ values of each area. For example, if L* that represents brightness, a* and b*, representing chromaticity, can be calculated with the following formulae:

$$L^*=116f(Y/Y_n)-16;$$

$$a^*=500(f(X/X_n)-f(Y/Y_n));$$

$$b^*=200(f(Y/Y_n)-f(Z/Z_n));$$

If $(X/X_n) \succ (24\times116)^{1/3}$, then $f(X/X_n)=(X/X_n)^{1/3}$; if $(X/X_n) \geq (24\times116)^{1/3}$, then $f(X/X_n)=(841/108)(X/X_n)+16/116$;

If $(Y/Y_n) \succ (24\times116)^{1/3}$, then $f(Y/Y_n)=(Y/Y_n)^{1/3}$; if $(Y/Y_n) \leq (24\times116)^{1/3}$, then $f(Y/Y_n)=(841/108)(Y/Y_n)+16/116$;

If $(Z/Z_n) \succ (24\times116)^{1/3}$, then $f(Z/Z_n)=(Z/Z_n)^{1/3}$; if $(Z/Z_n) \leq (24\times116)^{1/3}$, then $f(Z/Z_n)=(841/108)(Z/Z_n)+16/116$; wherein, $X_n$, $Y_n$, $Z_n$ are tristimulus values of a standard light source, which is generally $X_n=95.047$, $Y_n=100$, $Z_n=108.883$;

Then, the L* value in the CIE-Lab standard is taken as the L* value in the CIE-LCH standard, and the C* value of each area in the CIE-LCH standard is calculated based on the calculated a* b* values of each area in the CIE-Lab standard. For example, the C* value that represents chromaticity can be calculated with the following formula:

$$C^*=\sqrt{(a^*)^2+(b^*)^2};$$

wherein, if $\text{arc_tan}(b^*,a^*) \succ 0$, then $f(H)=(\text{arc_tan}(b^*,a^*)/\pi)\times180$; if $\text{arc_tan}(b^*,a^*) \leq 0$, then $f(H)=360-(|\text{arc_tan}(b^*,a^*)|/\pi)\times180$.

At step S104 statistical analysis is performed on the L* and C* values of the areas in the dark state image to determine statistical parameters of the display image. The statistical parameters may include: the maximum value, the mean value, the normally distributed 3σ value, and the Sobel value of the L* and C* values. Because the calculation of these statistical parameters belongs to the prior art, it will not be elaborated here.

At step S105 a dark state uniformity coefficient of the dark state image is determined based on the determined statistical parameters. Also, uniformity of the dark state image of the display panel is determined using the dark state uniformity coefficient. In specific implementations, first, a dark state brightness uniformity coefficient L mura and a dark state chroma uniformity coefficient C mura of the dark state image can be calculated respectively. Then, a dark state uniformity coefficient is obtained based on the preset proportions of these two coefficients. The greater the obtained dark state uniformity coefficient, the less uniform the dark state image is. Furthermore, a threshold line can be set. If the obtained dark state uniformity coefficient is above the threshold line, it will be reported for subsequent discarding or repair processing.

In specific implementations, the dark state brightness uniformity coefficient L mura and the dark state chroma uniformity coefficient C mura of the dark state image can be calculated respectively through the following formulae:

$$L\ \text{mura}=(\max_L-\text{mean}_L+3\sigma_L)/2+10*\text{area ratio}_L(\text{sobel value}_L>0.5/\text{degree}+100*\text{area ratio}_L(\text{sobel value}_L>10/\text{degree});$$

$$C\ \text{mura}=0.1*(\max_C+3\sigma_C)/2+10*\text{area ratio}_C(\text{sobel value}_C>5/\text{degree})+100*\text{area ratio}_C(\text{sobel value}_C>50/\text{degree});$$

wherein $\max_L$ represents the maximum value in the L* values of the areas, $\text{mean}_L$ represents the mean value in the L* values of the areas, $3\sigma_L$ represents the normally distributed 3σ value in the L* values of the areas, area $\text{ratio}_L$ (sobel $\text{value}_L>0.5$) represents the area ratio of the Sobel value in the L* value of each area greater than 0.5 degrees; area $\text{ratio}_L$ (sobel $\text{value}_L>10$/degree) represents the area ratio of the Sobel value in the L* value of each area greater than 10 degrees;

$\max_C$ represents the maximum value in the C* values of the areas, $\text{mean}_C$ represents the mean value in the C* values of the areas, $3\sigma_C$ represents the normally distributed 3σ value in the C* values of the areas, area $\text{ratio}_C$ (sobel $\text{value}_C>5$) represents the area ratio of the Sobel value in the C* value of each area greater than 5 degrees; area $\text{ratio}_C$ (sobel $\text{value}_C>50$/degree) represents the area ratio of the Sobel value in the C* value of each area greater than 50 degrees.

A dark state uniformity coefficient index mura of the dark state image is calculated based on the dark state brightness uniformity coefficient L mura and the dark state chroma uniformity coefficient C mura through the following formulae:

when L* is greater than a preset brightness value, for example, greater than 5 nit, index mura=0.5L mura+0.5C mura;

when L* is smaller than a preset brightness value, for example, smaller than 5 nit, index mura=0.7L mura+0.3C mura.

In specific implementations, in the above method for image detection provided by the embodiment of the present invention, in order for the finally calculated dark state uniformity coefficient to be more in line with the real condition of the dark state image, the converted tristimulus XYZ values can be amended based on empirical values detected by human eye.

Specifically, after the step S102 of calculating corresponding XYZ values of each area in the CIE-XYZ standard respectively based on the RGB values of each area is performed, other steps may also be performed. In some embodiments, a linear transformation of reverse colors is applied to the corresponding XYZ values of each area in the CIE-XYZ standard. Then, the linear transformed values are amended based on empirical values detected by human eye, and the amended values are inverse linear transformed into XYZ values.

Linear transformation of reverse colors is performed to the corresponding XYZ values of each area in the CIE-XYZ standard. The linear transformation of reverse colors can be performed to the corresponding XYZ values in the CIE-XYZ standard respectively through the following formulae:

$$W/B=0.279\times X+0.72\times Y-0.107\times Z;$$

$$R/G=-0.449\times X+0.29\times Y-0.077\times Z;$$

$$B/Y=0.086\times X+0.59\times Y-0.501\times Z;$$

wherein W/B represents reciprocal transformation of brightness, RIG represents reciprocal transformation from red to green, and B/Y represents reciprocal transformation from blue to yellow. The linear transformed values are amended based on empirical values detected by human eye. The W/B (representing reciprocal transformation of brightness), the R/G (representing reciprocal transformation from red to green), and the B/Y (representing reciprocal transformation from blue to yellow) can be amended respectively with the following functions:

$$f = k\sum_i w_i E_i,\ E_i = k_i \exp(-(x^2 + y^2)/s_i^2);$$

wherein $w_i$ represents weight coefficient, $s_i$ represents expansion coefficient, $k_i$ represents proportionality coefficient, and x, y and z represent coordinate values in chroma space, where x+y+z=1.

The following table shows some empirical values detected by human eye of $w_i$ and $s_i$ that correspond to the W/B representing reciprocal transformation of brightness, the R/G representing reciprocal transformation from red to green, and the B/Y representing reciprocal transformation from blue to yellow:

| | $w_i$ | $s_i$ |
|---|---|---|
| W/B | 0.921 | 0.0283 |
| | 0.105 | 0.133 |
| | −0.108 | 4.336 |
| R/G | 0.531 | 0.0392 |
| | 0.330 | 0.494 |
| B/Y | 0.488 | 0.0536 |
| | 0.371 | 0.386 |

Specifically, an inverse linear transformation is performed to the amended values. The amended W/B' (representing reciprocal transformation of brightness), the amended R/G' (representing reciprocal transformation from red to green), and the amended B/Y' (representing reciprocal transformation from blue to yellow) can be inverse linear transformed into the XYZ values through the following formulae:

$$X=0.6266\times(W/B)'-1.8672\times(R/G)'-0.1532\times(B/Y)'$$

$$Y=1.3699\times(W/B)'+0.9348\times(R/G)'+0.4362\times(B/Y)'.$$

$$Z=1.5057\times(W/B)'+1.4213\times(R/G)'+2.5360\times(B/Y)'$$

Based on the same inventive concept, an embodiment of the present invention further provides a device for image detection. Since the principle of the device for solving problems is similar as the preceding method for image detection, the implementation of the device may refer to the implementation of the method. The same parts will not be repeated.

Figure 2:
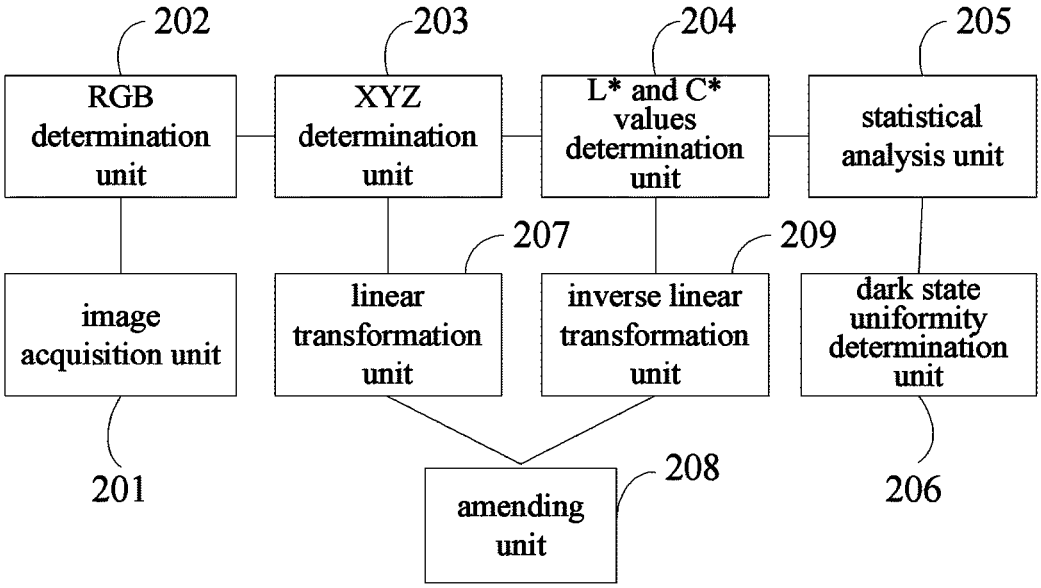
FIG. 2 is a structural schematic view of a device for image detection provided by an embodiment of the present invention.

A device for image detection provided by the embodiment of the present invention, as shown in FIG. 2, may include an image acquisition unit 201 for acquiring a dark state image of a display panel. In specific implementations, the image acquisition unit 201 may use image acquisition devices such as a CCD cemera for implementing the functions thereof.

An RGB determination unit 202 may determine RGB values for each area after the acquired dark state image of the display panel is divided into a plurality of areas according to a preset rule.

An XYZ determination unit 203 may calculate corresponding XYZ values of each area in the CIE-XYZ standard respectively based on the RGB values of each area.

An L* and C* value determination unit 204 may calculate L* and C* values of each area in the CIE-LCH standard respectively based on the XYZ values of each area.

A statistical analysis unit 205 may perform statistical analysis to the L* and C* values of the areas in the dark state image so as to determine statistical parameters of the display image. The statistical parameters may include the maximum value, the mean value, the normally distributed 3σ value, and the Sobel value of the L* and C* values.

A dark state uniformity determination unit 206 may determine a dark state uniformity coefficient of the dark state image based on the determined statistical parameters. The dark state uniformity determination unit 206 may further determine uniformity of the dark state image of the display panel using the dark state uniformity coefficient.

In some embodiments, the above device for image detection provided by the embodiment of the present invention, as shown in FIG. 2, further includes a linear transformation unit 207 for performing linear transformation of reverse colors to the corresponding XYZ values of each area in the CIE-XYZ standard. The device may also include an amending unit 208 for amending the linear transformed values based on empirical values of human eye. The device may further include an inverse linear transformation unit 209 for performing an inverse linear transformation to the amended values.

Furthermore, in the above device for image detection provided by the embodiment of the present invention, the linear transformation unit 207 may be used for performing linear transformation of reverse colors to the corresponding XYZ values in the CIE-XYZ standard respectively through the following formulae:

$$W/B=0.279\times X+0.72\times Y-0.107\times Z$$

$$R/G=-0.449\times X+0.29\times Y-0.077\times Z;$$

$$B/Y=0.086\times X+0.59\times Y-0.501\times Z$$

wherein W/B represents reciprocal transformation of brightness, R/G represents reciprocal transformation from red to green, B/Y represent reciprocal transformation from blue to yellow.

In the above device for image detection provided by the embodiment of the present invention, the amending unit 208 may be used for amending the W/B representing reciprocal transformation of brightness, the R/G representing reciprocal transformation from red to green, and the B/Y representing reciprocal transformation from blue to yellow respectively with the following functions:

$$f = k\sum_i w_i E_i,\ E_i = k_i \exp(-(x^2 + y^2)/s_i^2);$$

wherein $w_i$ represents weight coefficient, $s_i$ represents expansion coefficient, $k_i$ represents proportionality coefficient, and x, y and z represent coordinate values in chroma space, where x+y+z=1.

In the above device for image detection provided by the embodiment of the present invention, the inverse linear transformation unit 209 may be used for inverse linear transforming the amended W/B' representing reciprocal transformation of brightness, the amended RIG' representing reciprocal transformation from red to green, and the amended B/Y' representing reciprocal transformation from blue to yellow into the XYZ values through the following formulae:

$$X=0.6266\times(W/B)'-1.8672\times(R/G)'-0.1532\times(B/Y)'$$

$$Y=1.3699\times(W/B)'+0.9348\times(R/G)'+0.4362\times(B/Y)'.$$

$$Z=1.5057\times(W/B)'+1.4213\times(R/G)'+2.5360\times(B/Y)'$$

In the above device for image detection provided by the embodiment of the present invention, the L* and C* value determination unit 204 may be used for calculating L*. a*, and b* values of each area in the CIE-Lab standard respectively based on the XYZ values of each area. The L* and C* value determination unit 204 may also be used to calculate L* and C* values of each area in the CIE-LCH standard based on the calculated L*, a*, and b* values of each area in the CIE-Lab standard.

In the above device for image detection provided by the embodiment of the present invention, the dark state uniformity determination unit 206 may be used for calculating a dark state brightness uniformity coefficient L mura and a dark state chroma uniformity coefficient C mura of the dark state image respectively through the following formulae:

$$L\ \text{mura}=(\max_L-\text{mean}_L+3\sigma_L)/2+10*\text{area ratio}_L(\text{sobel value}_L>0.5/\text{degree}+100*\text{area ratio}_L(\text{sobel value}_L>10/\text{degree});$$

$$C\ \text{mura}=0.1*(\max_C+3\sigma_C)/2+10*\text{area ratio}_C(\text{sobel value}_C>5/\text{degree})+100*\text{area ratio}_C(\text{sobel value}_C>50/\text{degree});$$

wherein $\max_L$ represents the maximum value in the L* values of the areas, $\text{mean}_L$ represents the mean value in the L* values of the areas, $3\sigma_L$ represents the normally distributed 3σ value in the L* values of the areas, area $\text{ratio}_L$ (sobel $\text{value}_L>0.5$) represents the area ratio of the Sobel value in the L* value of each area greater than 0.5 degrees; area $\text{ratio}_L$ (sobel $\text{value}_L>10$/degree) represents the area ratio of the Sobel value in the L* value of each area greater than 10 degrees;

$\max_C$ represents the maximum value in the C* values of the areas, $\text{mean}_C$ represents the medium value in the C* values of the areas, $3\sigma_C$ represents the normally distributed 3σ value in the C* values of the areas, area $\text{ratio}_C$ (sobel $\text{value}_C>5$) represents the area ratio of the Sobel value in the C* value of each area greater than 5 degrees; area $\text{ratio}_C$ (sobel $\text{value}_C>50$/degree) represents the area ratio of the Sobel value in the C* value of each area greater than 50 degrees.

The dark state uniformity determination unit 206 may also be used for calculating a dark state uniformity coefficient index mura of the dark state image based on the dark state brightness uniformity coefficient L mura and the dark state chroma uniformity coefficient C mura through the following formulae:

when L* is greater than a preset brightness value, index mura=0.5L mura+0.5C mura;

when L* is smaller than a preset brightness value, index mura=0.7L mura+0.3C mura.

Through the above description of implementations, the skilled person in the art can learn clearly that the embodiments of the present invention can be either carried out through hardware, or can be carried out by means of software together with necessary general hardware platform. Based on such an understanding, the technical solutions of the embodiments of the present invention can be embodied in the form of a software product. The software product can be stored in a nonvolatile storage medium (which can be a CD-ROM, a U-disk, a mobile hard disk, etc.), including some instructions for enabling a computer device (which can be a personal computer, a server, or a network device, etc.) to carry out the method according to respective embodiments of the present invention.

The skilled person can understand that the drawings are only a schematic view of a preferred embodiment, the modules or flows in the drawing are not always necessary for carrying out the present invention.

The skilled person in the art can understand that the modules in the device in the embodiment can be distributed in the device of the embodiment according to the description of the embodiment, and can also make corresponding changes so as to be located in one or more devices that differ from the current embodiment. The modules in the above embodiment can be combined into one module, and can also be further divided into a plurality of sub-modules.

Apparently, the skilled person in the art can make various modifications and variations to the present invention without departing from the spirit and scope of the present invention. Thus, if these modifications and variations of the present invention belong to the scope of the claims of the present invention and its equivalent technology, the present invention also intends to cover these modifications and variations.

The invention claimed is:

1. A method for detecting uniformity of dark state image of a display, comprising:

after an acquired dark state image of a display panel is divided into a plurality of areas according to a preset rule, determining RGB values of each area;

calculating corresponding XYZ values of each area in the CIE-XYZ standard respectively based on the RGB values of each area;

calculating L* and C* values of each area in the CIE-LCH standard respectively based on the XYZ values of each area;

performing statistical analysis to the L* and C* values of the areas in the dark state image so as to determine statistical parameters of the display image; the statistical parameters comprising: a maximum value, a medium value, a normally distributed 3σ value, and a Sobel value of the L* and C* values;

determining a dark state uniformity coefficient of the dark state image based on the determined statistical parameters, and determining uniformity of the dark state image of the display panel through the dark state uniformity coefficient;

wherein after calculating corresponding XYZ values of each area in the CIE-XYZ standard respectively based on the RGB values of each area, the method further comprises:

performing linear transformation of reverse colors to the corresponding XYZ values of each area in the CIE-XYZ standard; and amending the linear transformed values based on empirical values of human eye, and performing an inverse linear transformation to the amended values.

2. The method as claimed in claim 1, wherein performing linear transformation of reverse colors to the corresponding XYZ values of each area in the CIE-XYZ standard comprises:

performing linear transformation of reverse colors to the corresponding XYZ values in the CIE-XYZ standard respectively through the following formulae:

$$W/B=0.279\times X+0.72\times Y-0.107\times Z$$

$$R/G=-0.449\times X+0.29\times Y-0.077\times Z;$$

$$B/Y=0.086\times X+0.59\times Y-0.501\times Z$$

wherein W/B represents reciprocal transformation of brightness, R/G represents reciprocal transformation from red to green, B/Y represent reciprocal transformation from blue to yellow.

3. The method as claimed in claim 2, wherein amending the linear transformed values based on empirical values of human eye comprises:

amending the W/B representing reciprocal transformation of brightness, the R/G representing reciprocal transformation from red to green, and the B/Y representing reciprocal transformation from blue to yellow respectively with the following functions:

$$f=k\sum_i w_i E_i,\ E_i=k_i\exp(-(x^2+y^2)/s_i^2);$$

wherein $w_j$ represents weight coefficient, $s_j$ represents expansion coefficient, $k_j$ represents proportionality coefficient, x, y and z represent coordinate values in chroma space, which meet x+y+z=1.

4. The method as claimed in claim 3, wherein performing an inverse linear transformation to the amended values comprises:

inverse linear transforming the amended W/B' representing reciprocal transformation of brightness, the amended R/G' representing reciprocal transformation from red to green, and the amended B/Y' representing reciprocal transformation from blue to yellow into the XYZ values through the following formulae:

$$X=0.6266\times(W/B)'-1.8672\times(R/G)'-0.1532\times(B/Y)'$$

$$Y=1.3699\times(W/B)'+0.9348\times(R/G)'+0.4362\times(B/Y)'$$

$$Z=1.5057\times(W/B)'+1.4213\times(R/G)'+2.5360\times(B/Y)'.$$

5. The method as claimed in claim 1, wherein calculating L* and C* values of each area in the CIE-LCH standard respectively based on the XYZ values of each area comprises:

calculating L*, a*, b* values of each area in the CIE-Lab standard respectively based on the XYZ values of each area;

calculating C* value of each area in the CIE-LCH standard based on the calculated a*, b* values of each area in the CIE-Lab standard, and taking the L* value in the CIE-Lab standard as the L* value in the CIE-LCH standard.

6. The method as claimed in claim 1, wherein determining a dark state uniformity coefficient of the dark state image based on the determined statistical parameters comprises:

calculating a dark state brightness uniformity coefficient L mura and a dark state chroma uniformity coefficient C mura of the dark state image respectively through the following formulae:

$$L\ \text{mura}=(\max_L-\text{mean}_L+3\sigma_L)/2+10*\text{area ratio}_L(\text{sobel value}_L>0.5/\text{degree}+100*\text{area ratio}_L(\text{sobel value}_L>10/\text{degree});$$

$$C\ \text{mura}=0.1*(\max_C+3\sigma_C)/2+10*\text{area ratio}_C(\text{sobel value}_C>5/\text{degree})+100*\text{area ratio}_C(\text{sobel value}_C>50/\text{degree});$$

wherein $\max_L$ represents the maximum value in the L* values of the areas, $\text{mean}_L$ represents the mean value in the L* values of the areas, $3\sigma_L$ represents the normally distributed 3σ value in the L* values of the areas, area $\text{ratio}_L$ (sobel $\text{value}_L$>0.5) represents the area ratio of the Sobel value in the L* value of each area greater than 0.5 degrees; area $\text{ratio}_L$ (sobel $\text{value}_L$>10/degree) represents the area ratio of the Sobel value in the L* value of each area greater than 10 degrees;

$\max_C$ represents the maximum value in the C* values of the areas, $\text{mean}_C$ represents the mean value in the C* values of the areas, $3\sigma_C$ represents the normally distributed 3σ value in the C* values of the areas, area $\text{ratio}_C$ (sobel $\text{value}_C$>5) represents the area ratio of the Sobel value in the C* value of each area greater than 5 degrees; area $\text{ratio}_C$ (sobel $\text{value}_C$>50/degree) represents the area ratio of the Sobel value in the C* value of each area greater than 50 degrees;

calculating a dark state uniformity coefficient index mura of the dark state image based on the dark state brightness uniformity coefficient L mura and the dark state chroma uniformity coefficient C mura through the following formulae:

when L* is greater than a preset brightness value, index mura=0.5L mura+0.5C mura;

when L* is smaller than a preset brightness value, index mura=0.7L mura+0.3C mura.

7. A device for detecting uniformity of dark state image of a display, comprising:

an image acquisition unit for acquiring a dark state image of a display panel;

an RGB determination unit for, after the acquired dark state image of the display panel is divided into a plurality of areas according to a preset rule, determining RGB values of each area;

an XYZ determination unit for calculating corresponding XYZ values of each area in the CIE-XYZ standard respectively based on the RGB values of each area;

an L* and C* value determination unit for calculating L* and C* values of each area in the CIE-LCH standard respectively based on the XYZ values of each area;

a statistical analysis unit for performing statistical analysis to the L* and C* values of the areas in the dark state image so as to determine statistical parameters of the display image; the statistical parameters comprising: a maximum value, a medium value, a normally distributed 3σ value, and a Sobel value of the L* and C* values;

a dark state uniformity determination unit for determining a dark state uniformity coefficient of the dark state image based on the determined statistical parameters, and determining uniformity of the dark state image of the display panel through the dark state uniformity coefficient;

a linear transformation unit for performing linear transformation of reverse colors to the corresponding XYZ values of each area in the CIE-XYZ standard;

an amending unit for amending the linear transformed values based on empirical values of human eye; and an inverse linear transformation unit for performing an inverse linear transformation to the amended values.

8. The device as claimed in claim 7, wherein the linear transformation unit is used for performing linear transformation of reverse colors to the corresponding XYZ values in the CIE-XYZ standard respectively through the following formulae:

$$W/B=0.279\times X+0.72\times Y-0.107\times Z$$

$$R/G=-0.449\times X+0.29\times Y-0.077\times Z;$$

$$B/Y=0.086\times X+0.59\times Y-0.501\times Z$$

wherein W/B represents reciprocal transformation of brightness, R/G represents reciprocal transformation from red to green, B/Y represent reciprocal transformation from blue to yellow.

9. The device as claimed in claim 8, wherein the amending unit is used for amending the W/B representing reciprocal transformation of brightness, the R/G representing reciprocal transformation from red to green, and the B/Y representing reciprocal transformation from blue to yellow respectively with the following functions:

$$f = k\sum_i w_i E_i,\ E_i = k_i \exp(-(x^2+y^2)/s_i^2);$$

wherein $w_j$ represents weight coefficient, $s_j$ represents expansion coefficient, $k_j$ represents proportionality coefficient, x, y and z represent coordinate values in chroma space, which meet x+y+z=1.

10. The device as claimed in claim 9, wherein the inverse linear transformation unit is used for inverse linear transforming the amended W/B' representing reciprocal transformation of brightness, the amended R/G' representing reciprocal transformation from red to green, and the amended B/Y' representing reciprocal transformation from blue to yellow into the XYZ values through the following formulae:

$$X=0.6266\times(W/B)'-1.8672\times(R/G)'-0.1532\times(B/Y)'$$

$$Y=1.3699\times(W/B)'+0.9348\times(R/G)'+0.4362\times(B/Y)'$$

$$Z=1.5057\times(W/B)'+1.4213\times(R/G)'+2.5360\times(B/Y)'.$$

11. The device as claimed in claim 7, wherein the L* and C value determination unit is used for calculating L*, a* b* values of each area in the CIE-Lab standard respectively based on the XYZ values of each area; calculating L* and C* values of each area in the CIE-LCH standard based on the calculated L* a* b* values of each area in the CIE-Lab standard.

12. The device as claimed in claim 7, wherein the dark state uniformity determination unit is used for calculating a dark state brightness uniformity coefficient L mura and a dark state chroma uniformity coefficient C mura of the dark state image respectively through the following formulae:

$$L\ \text{mura}=(\max_L-\text{mean}_L+3\sigma_L)/2+10*\text{area ratio}_L(\text{sobel value}_L>0.5/\text{degree}+100*\text{area ratio}_L(\text{sobel value}_L>10/\text{degree});$$

$$C\ \text{mura}=0.1*(\max_C+3\sigma_C)/2+10*\text{area ratio}_C(\text{sobel value}_C>5/\text{degree})+100*\text{area ratio}_C(\text{sobel value}_C>50/\text{degree});$$

wherein $\max_L$ represents the maximum value in the L* values of the areas, $\text{mean}_L$ represents the medium value in the L* values of the areas, $3\sigma_L$ represents the normally distributed 3σ value in the L* values of the areas, area $\text{ratio}_L$(sobel $\text{value}_L$>0.5) represents the area ratio of the Sobel value in the L* value of each area greater than 0.5 degrees; area $\text{ratio}_L$ (sobel $\text{value}_L$>10/degree) represents the area ratio of the Sobel value in the L* value of each area greater than 10 degrees;

$\max_C$ represents the maximum value in the C* values of the areas, $\text{mean}_C$ represents the medium value in the C* values of the areas, $3\sigma_C$ represents the normally distributed 3σ value in the C* values of the areas, area $\text{ratio}_C$(sobel $\text{value}_C$>5) represents the area ratio of the Sobel value in the C* value of each area greater than 5 degrees; area $\text{ratio}_C$ (sobel $\text{value}_C$>50/degree) represents the area ratio of the Sobel value in the C* value of each area greater than 50 degrees;

calculating a dark state uniformity coefficient index mura of the dark state image based on the dark state brightness uniformity coefficient L mura and the dark state chroma uniformity coefficient C mura through the following formulae:

when L* is greater than a preset brightness value, index mura=0.5L mura+0.5C mura;

when L* is smaller than a preset brightness value, index mura=0.7L mura+0.3C mura.

* * * * *